United States Patent [19]

Gurbst et al.

[11] 4,408,758

[45] Oct. 11, 1983

[54] FOOT SUPPORT FOR LAWN CHAIR SWING

[75] Inventors: Herbert S. Gurbst, Kingston; William Fulton, Dallas, both of Pa.

[73] Assignee: Roth American, Inc., Wilkes-Barre, Pa.

[21] Appl. No.: 202,308

[22] Filed: Oct. 30, 1980

[51] Int. Cl.[3] ..... A47C 15/00

[52] U.S. Cl. ..... 272/85; 297/245

[58] Field of Search ..... 280/47.41, 47.4, 47.39, 280/47.38; 272/1 R, 24, 33 R, 52, 54, 56.5 R, 85–92, 70, 70.3, 144, 145; 49/124; 248/163 A; 297/273–282, 5, 6, 9, 76, 77, 245, DIG. 10; 293/105, 119, 126, 136, 146

[56] References Cited

U.S. PATENT DOCUMENTS

| | | | |
|---|---|---|---|
| 663,495 | 12/1900 | Hayes | 272/85 X |
| 1,848,851 | 3/1932 | Thomas | 293/138 |
| 1,941,801 | 1/1934 | Harley | 293/105 X |
| 2,100,002 | 11/1937 | Evans et al. | 272/85 |
| 2,710,650 | 6/1955 | Sowder | 272/24 X |
| 2,711,898 | 6/1955 | Iasillo | 272/33 R |
| 3,090,634 | 5/1963 | Hesketh et al. | 293/102 |
| 3,248,125 | 4/1966 | Gill | 280/47.41 |
| 3,588,098 | 6/1971 | Stewart | 272/1 R |
| 4,208,069 | 6/1980 | Huber et al. | 293/102 |
| 4,256,300 | 3/1981 | Boucher | 272/85 |
| 4,280,731 | 7/1981 | Pitts et al. | 297/DIG. 4 |

FOREIGN PATENT DOCUMENTS

| | | | |
|---|---|---|---|
| 11769 | 2/1934 | Australia | 272/70.3 |

*Primary Examiner*—Richard C. Pinkham
*Assistant Examiner*—T. Brown
*Attorney, Agent, or Firm*—Burns, Doane, Swecker & Mathis

[57] ABSTRACT

A foot support structure adapted to be used with a seat of an oscillating lawn chair swing is disclosed. The foot support structure is provided with impact absorbing means preferably secured parallel to and spaced away from at least one edge portion of said support means to cushion the impact of the foot support. The impact absorbing means preferably comprises polyethylene tubes arranged generally parallel to an axis of oscillation of the lawn chair swing.

2 Claims, 7 Drawing Figures

FOOT SUPPORT FOR LAWN CHAIR SWING

BACKGROUND AND SUMMARY OF THE PRESENT INVENTION

The present invention relates generally to movable foot supports and to impact absorbing arrangements. More particularly the present invention relates to improvements in a foot support of a lawn swing arranged for generally oscillatory movement.

Foot supports are typically provided on lawn swings, and, less frequently, on other types of swings, so that persons sitting in a seat portion of the swing can rest their feet on the foot support. Lawn swing foot supports generally have a pair of parallel slat support rods with a plurality of parallel floor slats disposed transversely between the slat support rods. Generally, four vertically disposed members are provided to connect the foot support to the seat portion of the lawn swing.

As the lawn swing oscillates back and forth in an arc, the foot support, because it is typically furthest away from the point of oscillation of the swing, will scribe about the widest arc. If there are any bystanders, such as children at play, near the moving swing they risk being struck and injured by the swing and more particularly by the slats at the leading and trailing edges of the moving foot support. Especially in lawn swings, the large mass of the swing and of the occupants provides a significant force during swinging to seriously injure someone struck by the foot rest.

Various arrangements have been disclosed to provide an impact absorbing capability on equipment used by children, such as playground equipment. For example, U.S. Pat. No. 4,066,258 issued to Yates on Jan. 3, 1978 discloses an impact absorbing seat for a child's swing. The seat is provided with impact absorbing edges so that the seat may undergo a deformation of an outer polymeric seating material provided on the edges of the seat upon impact for example with a child. No foot support structure is disclosed in the Yates patent and none would normally be provided on a single seat playground swing such as is disclosed in the Yates patent.

A child's chair with an adjustable back rest is disclosed in U.S. Pat. No. 961,311 issued on June 14, 1910 to Nelson. The Nelson child's chair includes an adjustable foot rest having padded surfaces. The foot rest is padded on at least one side and is apparently constructed of a rigid material. The Nelson padded foot rest is apparently provided to provide a comfortable support for the legs of the occupant of the swing rather than to provide an impact absorbing arrangement.

A shin shield for a step ladder is disclosed in U.S. Pat. No. 2,518,107 issued on Aug. 8, 1950 to Wilson wherein an elongated sponge rubber block is detachably secured to a front edge of a step ladder to cushion the shins of a person using the step ladder.

Other arrangements for absorbing impacts to individuals by various devices are disclosed in the following U.S. Pat. Nos.: 3,884,495 issued to Petock on May 20, 1975; and 4,103,934 issued to Arnholt et al on Aug. 1, 1978.

U.S. Pat. No. De 208,643 issued on Sept. 19, 1967 to Gervais discloses a swing with a foot support. The foot support is not, however, shown to have an impact absorbing edge.

Accordingly, it is an object of the present invention to provide a foot support having at least one impact absorbing edge member for use with a swing in order to cushion an impact caused by the foot support if the foot support strikes a bystander.

It is another object of the present invention to provide an improved foot support especially for a lawn swing having an impact absorbing edge member arranged parallel to and spaced away from the foot support to constitute a leading edge portion or a trailing edge portion of the foot support so that the impact absorbing member can flex towards the foot support and absorb a larger impact than if the edge portion were provided immediately adjacent the foot support.

Yet still another object of the present invention is to provide an impact resistant lawn chair swing which substantially reduces the resulting injury to a child upon an accidental impact with a foot rest of the lawn swing.

An impact absorbing lawn chair swing according to the present invention includes a foot support structure for supporting a person's feet. An impact absorbing member is preferably secured parallel to and spaced away from at least one edge portion of the foot support to form a leading edge portion or a trailing edge portion of the foot support.

BRIEF DESCRIPTION OF THE DRAWINGS

A preferred embodiment of the impact absorbing lawn chair swing according to the present invention is described with reference to the accompanying drawings wherein like members bear like reference numerals and wherein.

DETAILED DESCRIPTION OF THE PREFERRED EMBODIMENT

Figure 1:
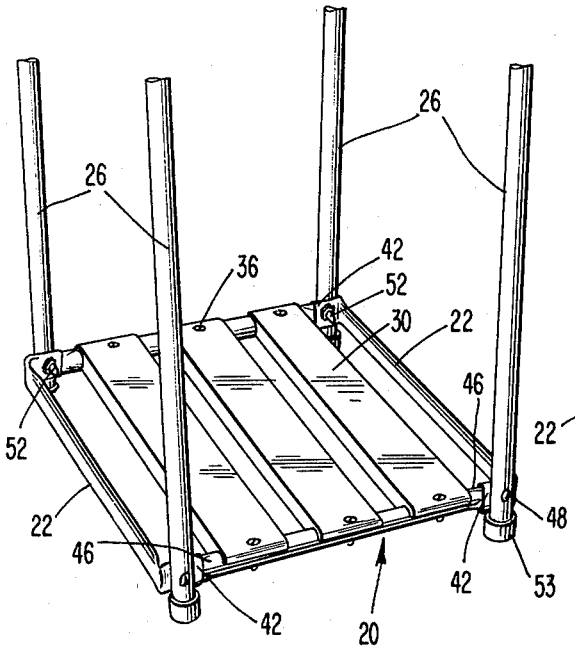
FIG. 1 is a perspective view of a preferred embodiment of a foot support of a lawn swing having impact absorbing members according to the present invention.

With reference to FIG. 1, a preferred embodiment of a foot support 20 for a conventional lawn chair swing according to the present invention has a pair of impact absorbing members 22. One of the impact absorbing members is provided on either end of the foot support structure 20. A connecting structure including four generally upright support members 26 connects the foot support 20 to a pair of opposed lawn swing seats 28 (see FIG. 6) such that the foot support 20 is disposed between and below the pair of seats 28.

Figure 2:
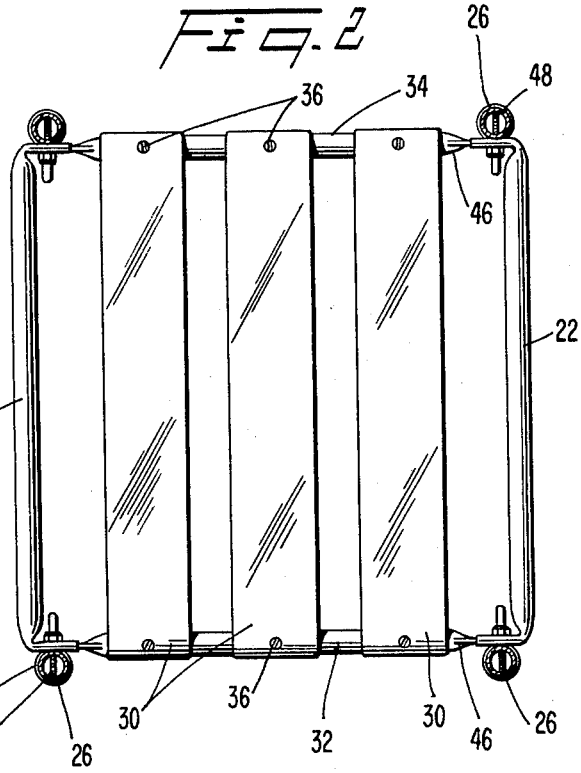
FIG. 2 is a top view of the foot support and the impact absorbing members of FIG. 1.

With reference now to FIG. 2, the foot support 20 preferably comprises a plurality of slats 30, secured to and disposed between a first slat support rod 32 and a second slat support rod 34. Both the plurality of slats 30 and the pair of slat support rods 32, 34 are preferably made of steel. The slats are secured to the slat support rods by a plurality of bolts 36.

Figure 3:
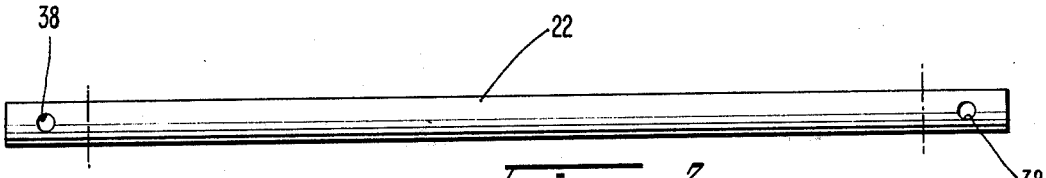
FIG. 3 is a side view of an impact absorbing member according to the present invention prior to being provided on the foot support of the lawn swing.
Figure 4:
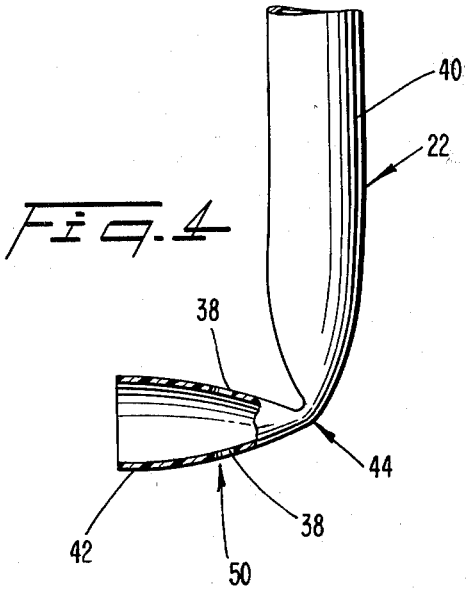
FIG. 4 is an enlarged side view in partial cross section of a portion of the impact absorbing member of FIG. 3 undergoing flexing at an end portion.
Figure 5:
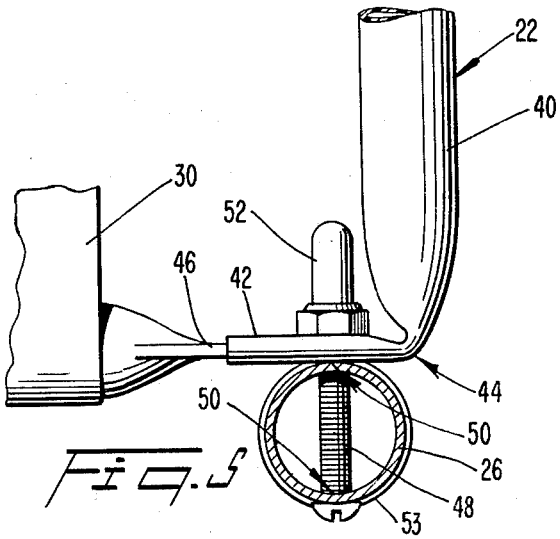
FIG. 5 is an enlarged view of a portion of the foot support and impact absorbing member of FIG. 2.

Each impact absorbing member 22 is preferably a flexible polyethylene tube (see FIG. 3) with a bore 38 provided in each end. The polyethylene tube provides a resiliency which can absorb the forces of impact with an individual in the manner of a huge rubber band stretched across the ends of the foot support 20. With reference to FIG. 4, each impact absorbing member 22 has a normally straight central portion 40 and two bent end portions 42 each with a corner 44 defined by a substantially 90° bend. In this way, the bent end portions 42 of the impact absorbing member 20 can be fitted over flattened end portions 46 of the first and second slat support rods 32, 34 respectively (see FIG. 5). The end portions 42 of the impact absorbing edge member thus cover any sharp edges which may be created in the flattened end portions 46 of the metal slat support rods by the flattening and trimming process that the end portions undergo.

The impact absorbing members 22 are connected at each bent portion 42 to the foot support structure 20 as well as to one of the plurality of upright support members 26 of the connecting structure by a bolt 48. Each bolt 48 is inserted through a bore 50 extending sequentially through the upright 26, through one side of the impact absorbing member 22, the associated end 46 of one of the slat support rods 32, 34 and finally through the other side of the impact absorbing member 22 (i.e. the bore 38). Each bolt 48 is held in place by a lock nut with an associated bolt cover 52, preferably made of plastic, shielding any rough metal surfaces on an end of a shank portion of the bolt 48. Finally an end cap 53 is provided on a lower end of each of the uprights 26 so as to likewise shield any rough metal surfaces of the end of the upright.

Figure 7:
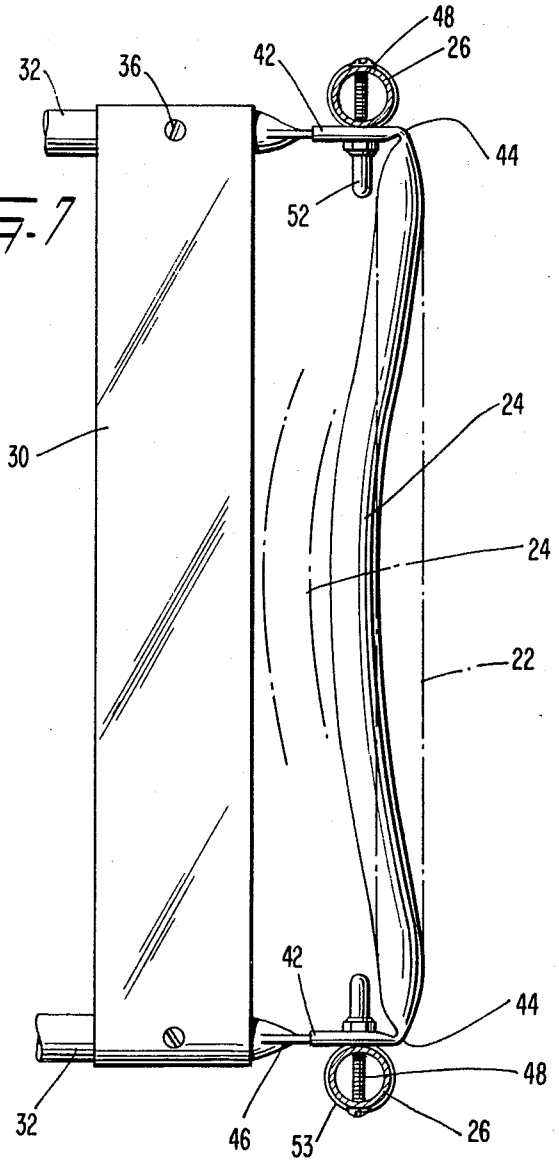
FIG. 7 is a view of an end portion of the foot support and associated impact absorbing member of FIG. 2 undergoing deflection due to impact.

If a lawn swing having a foot support structure, equipped with an impact absorbing edge member according to the present invention strikes someone, for example, a child, the force of impact will be absorbed, at least in part, by a deformation of the impact absorbing edge member 22 as may be seen in FIG. 7, the unitary impact absorbing edge member 24 is operable to bodily yield as a unit toward the slat 30. Thus, injury will be avoided or at least the amount of any injury to the person struck will be minimized. Depending upon the severity of the impact, the central portion 40 of the member 22 may only flex slightly inwardly. A more substantial impact will deform the central portion 40 to a correspondingly greater extend. A very substantial impact may either shear the member 22 at the bolts 48 or urge the end portions 46 of the rods 32, 34 to flex towards one another. Of course, once the member 22 abuts the adjacent slat 30, the foot support will share the force of impact with the member 22. By this time, however, the force of impact will likely be significantly reduced.

The extent to which the slat support rods 32, 34 may also flex to thus cooperate with the impact absorbing member 22 depends upon the particular construction of the foot support 20. By extending the length of the end portions 46, for example, the impact absorbing member 22 would then be enabled to flex more and to thus absorb a greater impact when the foot support structure 20 strikes a relatively immovable object. The extent to which the end portions 46 of the support rods 32, 34 can flex depends upon the material from which those rods are made and upon the extent that each end portion 46 of each slot support rod 32, 34 extends past an outermost one of the slats, on how much flexure the slats allow and on how much flexure the uprights 26 of the connecting structure allow.

In addition to securing the mid-section 40 of the flexible tube 22 to the foot support, the ends 42 of the flexible tube 22 provide an impact absorbing feature for the end portions 46 of the support rods 32, 34. By providing a plastic outer surface over the oftentimes rough edges of the end portions 46, the resultant injury from impact with the end portions 46 will be substantially lessened or eliminated.

Figure 6:
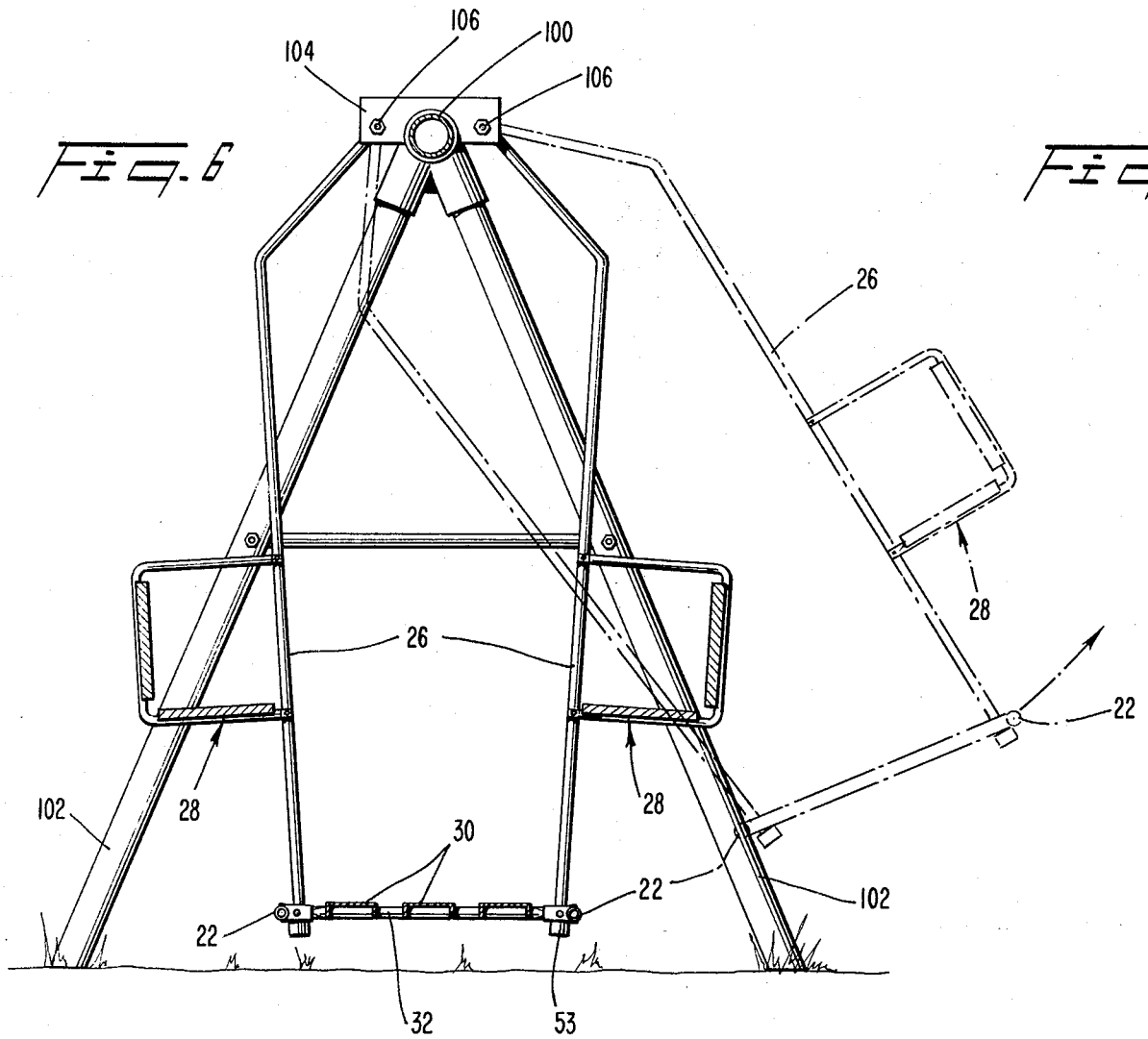
FIG. 6 is a side view of a lawn swing having the foot support and impact absorbing members of FIG. 1.

With reference to FIG. 6, a suitable conventional lawn chair swing includes a relatively rigid support structure formed by a pair of triangular braces arranged at either end of a main cross support member 100. The triangular braces are formed by first and second leg members 102 which are typically secured into the ground at a lower end. A pair of brackets 104 (one of which is shown in FIG. 6) rests upon the cross support member 100, with the generally upright support members 26 being pivotally connected to the brackets at spaced pivots 106. In this way, a four bar type linkage is provided with the foot support forming a lower member of the four bar linkage and the spaced pivots 106 of the bracket forming the upper member. The upright support members 26 form side members of the four bar linkage.

While the four bar linkage of a lawn chair swing does not provide a true axis of oscillation (as in a pendulum, for example), the lawn chair swing may be considered as oscillating about parallel axes passing through the spaced pivots 106 of the brackets 104.

As shown in FIG. 6, the seats 28 may be supported directly at a midsection of the upright support members 26. During an extreme extent of the oscillating movement of the lawn chair swing, the impact absorbing members 22 define the substantially outermost portion of the swing. In this way, the members 22 are located at the portion of the swing most likely to strike a person inadvertently and also most likely to inflict injury to a struck person.

The impact absorbing members 22 can be provided on a foot support structure adapted for either a two person lawn chair swing or a four person lawn chair swing. Likewise, the members 22 can be provided on a lawn chair swing with only one seat (not illustrated) or with facing seats. It should also be appreciated, however, that an impact absorbing member according to the present invention may be provided on a foot support structure adapted to be used with, for example, a porch swing, (not illustrated), a single seat playground swing (not illustrated) or any other swinging seat structure which may have a foot support structure attached thereto.

The principles, preferred embodiments and modes of operation of the present invention have been described in the foregoing specification. The invention which is intended to be protected herein should not be construed as limited to the particular forms disclosed, since these are to be regarded as illustrative rather than restrictive. Variations and changes may be made by those skilled in the art without departing from the spirit of the present invention.

What is claimed is:

1. A foot support structure disposed between and below a pair of opposed seats in an oscillating lawn chair swing, the foot support structure comprising:

a first slat support rod;

a second slat support rod;

a first impact absorbing flexible plastic tube secured to and disposed between a first end of each of the first and second slat support rods to form an outer edge of the foot support;

a second impact absorbing flexible plastic tube secured to and disposed between a second end of each of the first and second slat support rods to form another outer edge of the foot support, said first and second flexible plastic tubes being generally parallel with an axis of oscillation of the lawn chair swing;

at least one floor slat secured to and disposed between said first and second slat support rods and also disposed between said first and second plastic tubes; and means for suspending the foot support structure from the lawn chair swing.

2. The foot support structure of claim 1 wherein a first and a second end portion of each of the first and second plastic tubes are bent substantially 90° and slipped over and secured to the first and second ends of the first and second slat support rods, said first and second plastic tubes being spaced away from an edge of said at least one floor slat, said first and second end portions of each of the first and second plastic tubes covering any rough edges of said first and second ends of the first and second slat support rods.

* * * * *